US010302330B2

(12) United States Patent
Tashiro

(10) Patent No.: US 10,302,330 B2
(45) Date of Patent: May 28, 2019

(54) REFRIGERATION CYCLE APPARATUS AND AIR-CONDITIONING APPARATUS

(71) Applicant: Mitsubishi Electric Corporation, Tokyo (JP)

(72) Inventor: Yusuke Tashiro, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 112 days.

(21) Appl. No.: 15/504,349

(22) PCT Filed: Sep. 17, 2014

(86) PCT No.: PCT/JP2014/074511

§ 371 (c)(1),
(2) Date: Feb. 16, 2017

(87) PCT Pub. No.: WO2016/042613

PCT Pub. Date: Mar. 24, 2016

(65) Prior Publication Data

US 2017/0234589 A1 Aug. 17, 2017

(51) Int. Cl.
*F24F 11/41* (2018.01)
*F24F 11/42* (2018.01)
(Continued)

(52) U.S. Cl.
CPC ..... *F24F 11/89* (2018.01); *F25B 13/00* (2013.01); *F25B 47/02* (2013.01); *F25B 47/022* (2013.01);
(Continued)

(58) Field of Classification Search
CPC ..... F24F 11/42; F25B 13/00; F25B 39/022; F25B 41/04; F25B 47/02;
(Continued)

(56) References Cited

U.S. PATENT DOCUMENTS

2014/0070132 A1 3/2014 Fukushima

FOREIGN PATENT DOCUMENTS

JP H07-055236 A 3/1995
JP 11257718 A * 9/1999 ..... F24F 11/02
(Continued)

OTHER PUBLICATIONS

Whitman, B. (2012). Refrigeration and Air Conditioning Technology. Sted: Cengage Learning, Inc. 7th Edition, p. 1272.*
(Continued)

*Primary Examiner* — Henry T Crenshaw
*Assistant Examiner* — Chang H. Park
(74) *Attorney, Agent, or Firm* — Posz Law Group, PLC

(57) ABSTRACT

A refrigeration cycle apparatus including a refrigerant circuit including a compressor, an indoor heat exchanger, an expansion device, an outdoor heat exchanger, an outside air temperature sensor, and a controller configured to perform a hot gas defrosting operation and a reverse-defrosting operation based on a temperature obtained by the outside air temperature sensor. In the hot gas defrosting operation, hot gas discharged from the compressor without passing through the indoor heat exchanger is supplied to the outdoor heat exchanger. In the reverse-defrosting operation, refrigerant passing through the indoor heat exchanger is supplied from the compressor to the outdoor heat exchanger. The controller has at least a mixed defrosting operation mode in which the hot gas defrosting operation and the reverse-defrosting operation are performed in sequence. The controller is configured to start the mixed defrosting operation mode when the temperature obtained by the outside air temperature sensor satisfies a preset condition.

7 Claims, 6 Drawing Sheets

(51) Int. Cl.

| | |
|---|---|
| ***F24F 11/89*** | (2018.01) |
| ***F25B 13/00*** | (2006.01) |
| ***F25B 39/00*** | (2006.01) |
| ***F25B 39/02*** | (2006.01) |
| ***F25B 47/02*** | (2006.01) |
| ***F25D 21/00*** | (2006.01) |
| ***F25D 21/06*** | (2006.01) |

(52) U.S. Cl.
CPC ..... *F25B 47/025* (2013.01); *F24F 11/41* (2018.01); *F24F 11/42* (2018.01); *F25B 39/00* (2013.01); *F25B 39/02* (2013.01); *F25B 39/022* (2013.01); *F25B 2313/0314* (2013.01); *F25B 2313/0315* (2013.01); *F25B 2347/02* (2013.01); *F25B 2347/021* (2013.01); *F25B 2700/21* (2013.01); *F25B 2700/2106* (2013.01); *F25D 21/00* (2013.01); *F25D 21/06* (2013.01)

(58) Field of Classification Search
CPC ..... F25B 2341/0662; F25B 2400/12; F25D 21/06; F25D 21/14; F28D 1/0435; F28D 1/053; F28D 2021/0068; F28D 2021/0071; F28F 1/32; F28F 17/00; F28F 17/005; F28F 2215/02; F28F 2215/12; F28F 2245/04
See application file for complete search history.

(56) References Cited

FOREIGN PATENT DOCUMENTS

| | | | | | |
|---|---|---|---|---|---|
| JP | H11-257718 | A | | 9/1999 | |
| JP | 2000-035265 | A | | 2/2000 | |
| JP | 2000035265 | A | * | 2/2000 | ..... F25B 1/00 |
| JP | 2002-107014 | A | | 4/2002 | |
| JP | 2011-085320 | A | | 4/2011 | |
| JP | 2011-144960 | A | | 7/2011 | |
| JP | 2011144960 | A | * | 7/2011 | ..... F25B 47/02 |
| JP | 2014-098166 | A | | 5/2014 | |
| JP | 2014098166 | A | * | 5/2014 | ..... F25B 9/002 |

OTHER PUBLICATIONS

International Search Report of the International Searching Authority dated Dec. 16, 2014 for the corresponding international application No. PCT/JP2014/074511 (and English translation).
Office Action dated Jun. 23, 2015 issued in corresponding JP patent application No. 2015-517522 (and English translation).

* cited by examiner

| FIRST TEMPERATURE (0°C) | SECOND TEMPERATURE (2°C) | |
|---|---|---|
| EQUAL TO OR LOWER THAN FIRST TEMPERATURE | HIGHER THAN FIRST TEMPERATURE AND EQUAL TO OR LOWER THAN SECOND TEMPERATURE | HIGHER THAN SECOND TEMPERATURE |
| REVERSE-DEFROSTING OPERATION | HOT GAS DEFROSTING OPERATION → REVERSE-DEFROSTING OPERATION | HOT GAS DEFROSTING OPERATION |

REFRIGERATION CYCLE APPARATUS AND AIR-CONDITIONING APPARATUS

CROSS REFERENCE TO RELATED APPLICATION

This application is a U.S. national stage application of PCT/JP2014/074511 filed on Sep. 17, 2014, the contents of which are incorporated herein by reference.

TECHNICAL FIELD

The present invention relates to a refrigeration cycle apparatus and an air-conditioning apparatus.

BACKGROUND ART

For example, when a heating operation is performed by using an air-conditioning apparatus in winter, an outdoor heat exchanger mounted on an outdoor unit serves as an evaporator, and thus frost is formed on the outdoor heat exchanger in some cases. Examples of conventional disclosed air-conditioning apparatuses include an air-conditioning apparatus that performs a hot gas defrosting operation in which hot gas refrigerant discharged from a compressor is supplied to the outdoor heat exchanger, and an air-conditioning apparatus that performs a reverse-defrosting operation in which frost on the outdoor heat exchanger is removed by using heat of an indoor heat exchanger mounted on an indoor unit (refer to Patent Literature 1 and Patent Literature 2, for example).

CITATION LIST

Patent Literature

Patent Literature 1: Japanese Unexamined Patent Application Publication No. 2000-35265

Patent Literature 2: Japanese Unexamined Patent Application Publication No. 7-55236

SUMMARY OF INVENTION

Technical Problem

In the hot gas defrosting operation, the heat of the indoor heat exchanger is not used, but hot gas discharged from the compressor directly supplied to the outdoor heat exchanger. Thus, when a heating operation is started after the defrosting operation, some heat due to a heating operation performed before the defrosting operation remains in the indoor heat exchanger. Consequently, an increase in a time required for a rise of the heating operation can be reduced in the hot gas defrosting operation.

In the reverse-defrosting operation, the indoor unit is used as a heat radiating source, and thus defrosting performance is achieved to be higher than that of the hot gas defrosting operation. Consequently, defrosting of the outdoor heat exchanger can be completed in a short time.

However, when the hot gas defrosting operation is independently performed, or the reverse-defrosting operation is independently performed, a longer time is required for defrosting and for the rise of the heating operation.

The present invention is intended to solve the above-described problems and to provide a refrigeration cycle apparatus and an air-conditioning apparatus that each can achieve reduction of an increase in a defrosting time and reduction of an increase in a time required for a rise of a heating operation.

Solution to Problem

A refrigeration cycle apparatus according to an embodiment of the present invention including a refrigerant circuit including a compressor, an indoor heat exchanger, an expansion device, and an outdoor heat exchanger connected to each other via refrigerant pipes, an outside air temperature sensor used to measure an outside air temperature, and a controller configured to perform a hot gas defrosting operation and a reverse-defrosting operation on the basis of a measured temperature obtained by the outside air temperature sensor. In the hot gas defrosting operation, hot gas discharged from the compressor without passing through the indoor heat exchanger is supplied to the outdoor heat exchanger. In the reverse-defrosting operation, refrigerant passing through the indoor heat exchanger is supplied from the compressor to the outdoor heat exchanger. The controller has at least a mixed defrosting operation mode in which the hot gas defrosting operation and the reverse-defrosting operation are performed in sequence. The controller is configured to start the mixed defrosting operation mode when the measured temperature obtained by the outside air temperature sensor satisfies a preset condition.

Advantageous Effects of Invention

The refrigeration cycle apparatus according to the embodiment of the present invention is configured to select the mode of the defrosting operation in response to a load of the defrosting operation corresponding to the outside air temperature, and has the mixed defrosting operation mode subsequently executed after the hot gas defrosting operation is performed. Thus, the outdoor heat exchanger is defrosted through the hot gas defrosting operation to some extent, and then remaining frost can be removed by another hot gas defrosting operation having higher performance. Consequently, reduction of an increase in a defrosting time and reduction of an increase in a time required for a rise of a heating operation can be both achieved.

DESCRIPTION OF EMBODIMENTS

Figure 1:
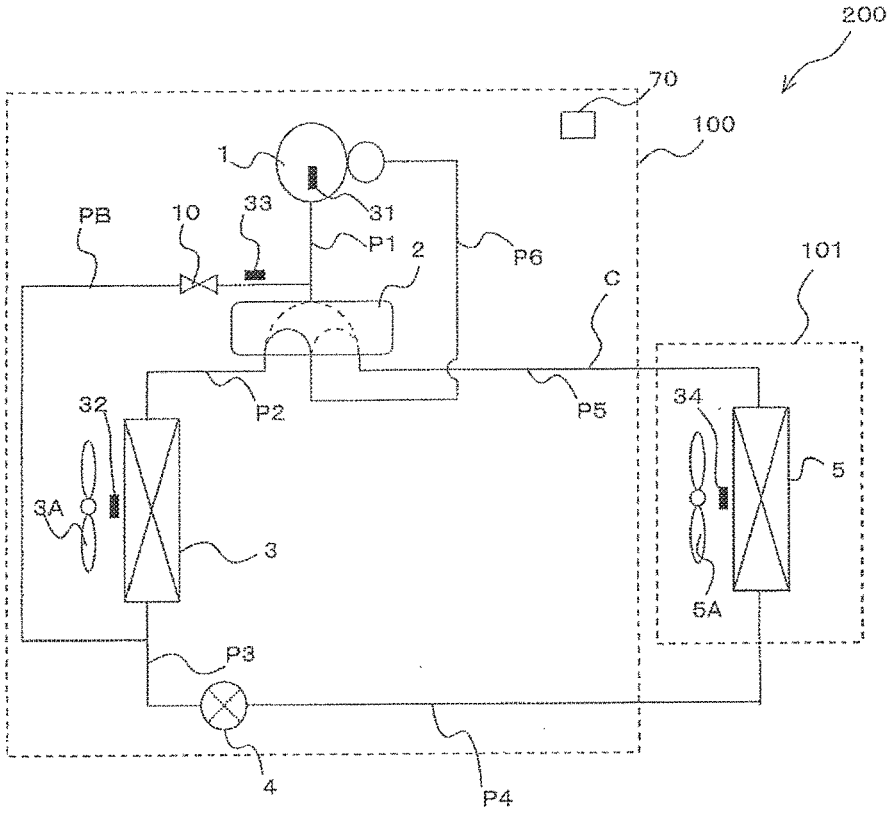
FIG. 1 is a diagram schematically illustrating a refrigerant circuit configuration and any other configuration of a refrigeration cycle apparatus 200 according to an embodiment of the present invention.

An embodiment of a refrigeration cycle apparatus and an air-conditioning apparatus according to the present invention will be described below with reference to the accompanying drawings. The embodiment described below is not intended to limit the present invention. In FIG. 1 and the following diagrams, a dimensional relation among components is different from an actual relation in some cases.

Embodiment

FIG. 1 is a diagram schematically illustrating a refrigerant circuit configuration and any other configuration of a refrigeration cycle apparatus 200 according to the present embodiment. The refrigerant circuit configuration and any other configuration of the refrigeration cycle apparatus 200 will be described with reference to FIG. 1.

[Description of Configuration]

The refrigeration cycle apparatus 200 includes an outdoor unit 100 that is a heat source apparatus, and an indoor unit 101 that is a use side device. The outdoor unit 100 and the indoor unit 101 are connected to each other via a refrigerant pipe P4 and a refrigerant pipe P5.

The refrigeration cycle apparatus 200 includes a compressor 1 configured to compress and discharge refrigerant, a flow switching device 2 configured to switch refrigerant passages, an outdoor heat exchanger 3 that is a heat-source side heat exchanger, an expansion device 4 configured to decompress the refrigerant, and an indoor heat exchanger 5 that is a use side heat exchanger. The refrigeration cycle apparatus 200 includes an outdoor fan 3A provided to the outdoor heat exchanger 3, and an indoor fan 5A provided to the indoor heat exchanger 5.

The refrigeration cycle apparatus 200 includes a refrigerant pipe P1 connecting a discharge side of the compressor 1 and the flow switching device 2, a refrigerant pipe P2 connecting the flow switching device 2 and the outdoor heat exchanger 3, a refrigerant pipe P3 connecting the outdoor heat exchanger 3 and the expansion device 4, the refrigerant pipe P4 connecting the expansion device 4 and the indoor heat exchanger 5, the refrigerant pipe P5 connecting the indoor heat exchanger 5 and the flow switching device 2, and a refrigerant pipe P6 connecting the flow switching device 2 and a suction side of the compressor 1.

The refrigeration cycle apparatus 200 includes a bypass pipe PB connected to bypass the expansion device 4 and the indoor heat exchanger 5, and an opening-closing device 10 provided to the bypass pipe PB. The bypass pipe PB has one end connected to the refrigerant pipe P1, and the other end connected to the refrigerant pipe P3. The opening-closing device 10 may be, for example, an on-off valve.

The refrigeration cycle apparatus 200 includes an outside air temperature sensor 30 configured to measure an outside air temperature, a compressor temperature sensor 31 configured to measure the temperature of the refrigerant discharged from the compressor 1, an outdoor heat exchanger temperature sensor 32 configured to measure the temperature of the outdoor heat exchanger 3, a bypass pipe temperature sensor 33 configured to measure the temperature of the bypass pipe PB, and an indoor heat exchanger temperature sensor 34 configured to measure the temperature of the indoor heat exchanger 5. The refrigeration cycle apparatus 200 also includes a controller 70 that controls a rotation frequency of the compressor 1 and any other parameter on the basis of a measured temperature obtained by each above-described sensor. The controller 70 has, as operation modes, a hot gas defrosting operation mode, a reverse-defrosting operation mode, and a mixed defrosting operation mode to be described later, and can select from these modes on the basis of an outside air temperature.

The refrigeration cycle apparatus 200 includes the compressor 1, the flow switching device 2, the outdoor heat exchanger 3, the expansion device 4, the indoor heat exchanger 5, and the opening-closing device 10, and includes a refrigerant circuit C in which these components are connected to each other via the refrigerant pipes P1 to P6 and the bypass pipe PB.

Figure 2:
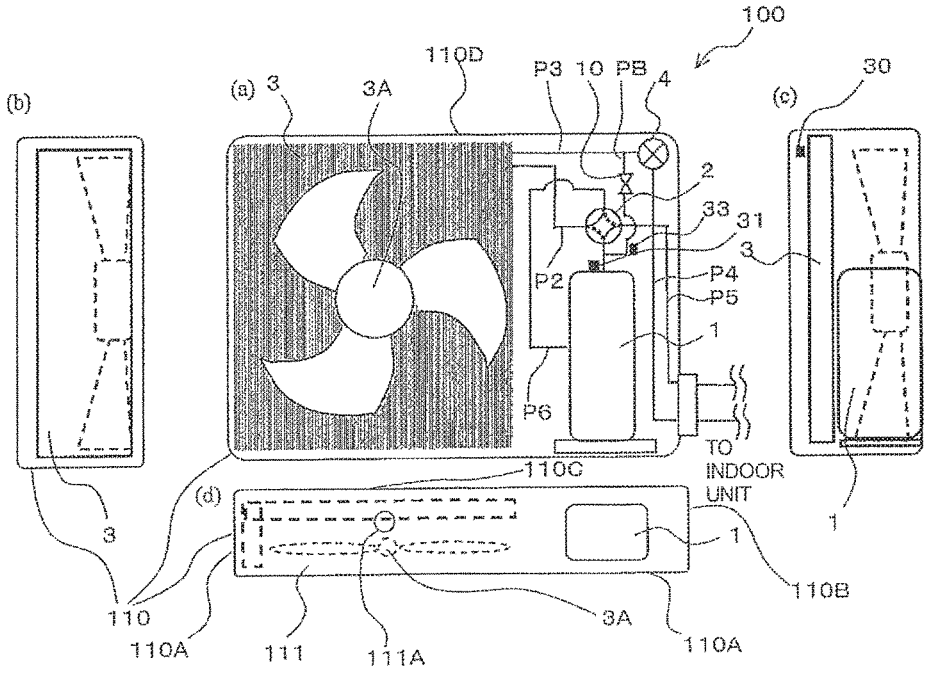
FIG. 2 is a pattern diagram of an outdoor unit 100 of the refrigeration cycle apparatus 200 according to the embodiment of the present invention.
Figure 3:
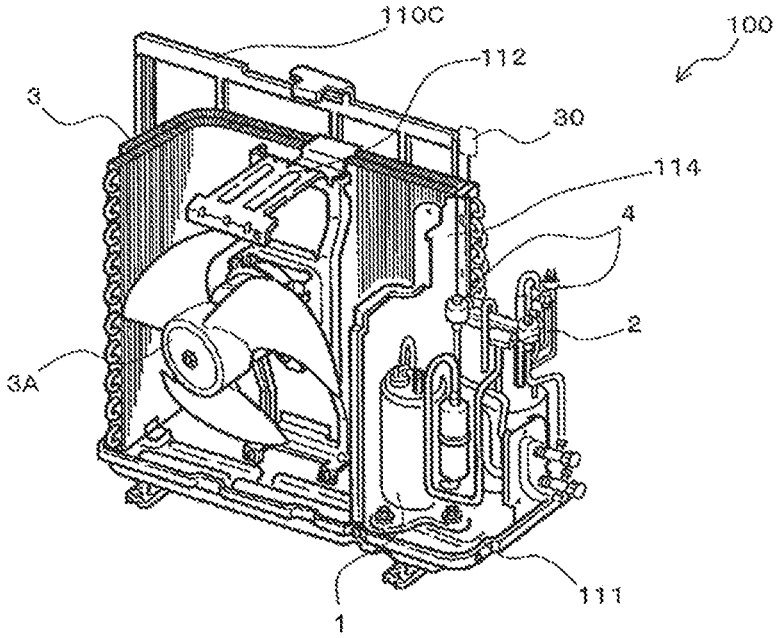
FIG. 3 is a perspective view of the refrigeration cycle apparatus 200 according to the embodiment of the present invention when a housing of the refrigeration cycle apparatus 200 is partially removed to expose an inner structure for viewing.

FIG. 2 is a pattern diagram of the outdoor unit 100 of the refrigeration cycle apparatus 200 according to the present embodiment. FIG. 3 is a perspective view of the refrigeration cycle apparatus 200 according to the present embodiment when a housing of the refrigeration cycle apparatus 200 is partially removed to expose an inner structure for viewing. FIG. 2 (*a*) is a pattern diagram of the outdoor unit 100 when the outdoor unit 100 is viewed from a front side, FIG. 2 (*b*) is a pattern diagram of the outdoor unit 100 when the outdoor unit 100 is viewed from a side on which the outdoor heat exchanger 3 is provided, FIG. 2 (*c*) is a pattern diagram of the outdoor unit 100 when the outdoor unit 100 is viewed from a side on which the compressor 1 is provided, and FIG. 2 (*d*) is a pattern diagram of the outdoor unit 100 when the outdoor unit 100 is viewed from a bottom surface side. The configuration and any other configuration of the outdoor unit 100 will be described with reference to FIGS. 2 and 3.

The outdoor unit 100 includes a housing 110 in which the compressor 1, the flow switching device 2, the outdoor heat exchanger 3, the expansion device 4, the opening-closing device 10, the outdoor fan 3A, the outside air temperature sensor 30, the compressor temperature sensor 31, the bypass pipe temperature sensor 33, and other component are mounted. The housing 110 includes, for example, a fan grille (not illustrated), and includes a front panel 110A having an L-shaped horizontal section, a side panel 110B disposed on a side of the compressor 1, a back panel 110C provided facing to the outdoor heat exchanger 3, and a top panel 110D disposed on the front panel 110A, the side panel 110B, and the back panel 110C.

The housing 110 is provided with the front panel 110A, the side panel 110B, and the back panel 110C attached to its periphery, and includes a base plate 111 on which, for example, the outdoor heat exchanger 3 and the compressor 1 are placed. The base plate 111 has a drain hole 111A through which, for example, drain water dropped from the outdoor heat exchanger 3 flows out. The outdoor unit 100 is provided with a motor support 112 that has an upper part that is hooked to the outdoor heat exchanger 3, and a lower part that is fixed to the base plate 111, and to which the outdoor fan 3A is provided. The outdoor unit 100 is provided with a dividing plate 114 for partition into a heat exchanger compartment in which, for example, the outdoor heat exchanger 3 and the outdoor fan 3A are installed, and a compressor compartment in which, for example, the compressor 1, the flow switching device 2, and the expansion device 4 are installed.

[Configuration of the Outdoor Heat Exchanger 3]

Figure 4A:
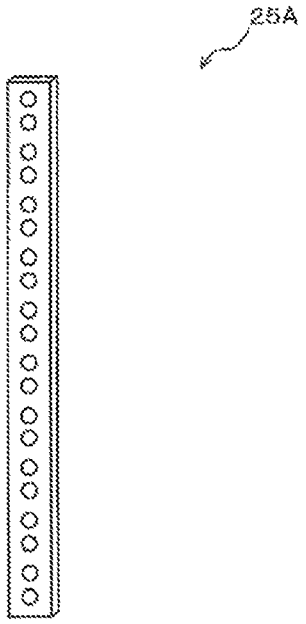
FIG. 4A is an explanatory diagram of a fin 25A included in an outdoor heat exchanger 3 illustrated in FIGS. 1 to 3.
Figure 4B:
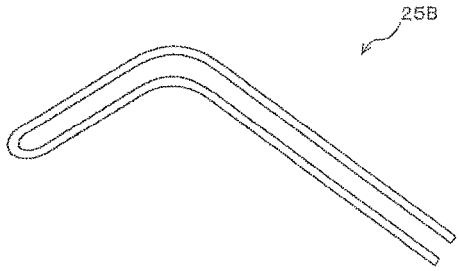
FIG. 4B is an explanatory diagram of a heat transfer pipe 25B included in the outdoor heat exchanger 3 illustrated in FIGS. 1 to 3.

FIG. 4A is an explanatory diagram of a fin 25A included in the outdoor heat exchanger 3 illustrated in FIGS. 1 to 3. FIG. 4B is an explanatory diagram of a heat transfer pipe 25B included in the outdoor heat exchanger 3 illustrated in FIGS. 1 to 3. FIG. 4A illustrates one of a plurality of the fins 25A included in the outdoor heat exchanger 3, and FIG. 4B illustrates one of the heat transfer pipes 25B included in the outdoor heat exchanger 3. The plurality of heat transfer pipes 25B are welded to each other via, for example, a U-shaped pipe. The configuration of the outdoor heat exchanger 3 will be described with reference to FIGS. 4A and 4B.

The outdoor heat exchanger 3 includes the heat transfer pipe 25B connected to the refrigerant pipe P2 and the refrigerant pipe P3 and made of aluminum, and the plurality of fins 25A connected to the heat transfer pipe 25B. When the heat transfer pipe 25B is made of aluminum, a manufacturing cost of the heat transfer pipe 25B is advantageously reduced as compared to a case in which the heat transfer pipe 25B is made of, for example, copper.

The outdoor heat exchanger 3 is configured so that a ratio of a heat capacity of the plurality of fins 25A to a total of heat capacities of the heat transfer pipe 25B and the plurality of fins 25A is not more than 50%. As the heat transfer pipe 25B is made of aluminum, the thickness of the pipe is increased so that the ratio is not more than this numerical value. This configuration will be described in detail below.

When the number of the fins 25A and the material of the fins 25A are fixed, the total heat capacity of the outdoor heat exchanger 3 is increased by, for example, (1) increasing the number of the heat transfer pipes 25B, (2) increasing the thickness of the heat transfer pipe 25B, and (3) changing the material of the heat transfer pipe 25B to a material having a large heat capacity. In the present embodiment, the thickness of the heat transfer pipe 25B is changed as for (2), while the material is aluminum as for (3), and the number of the heat transfer pipes 25B is fixed as for (1) for simplicity of description.

In the outdoor heat exchanger 3, the heat transfer pipe 25B is made of aluminum. Thus, the heat transfer pipe 25B is inferior to a heat transfer pipe made of copper or other materials in, for example, pressure resistance for a fixed thickness. For this reason, the thickness of the heat transfer pipe 25B is increased. Specifically, in the outdoor heat exchanger 3, the thickness of the heat transfer pipe 25B is set so that the ratio of the heat capacity of the plurality of fins 25A to the total of heat capacities of the heat transfer pipe 25B and the plurality of fins 25A is not more than 50%.

The above discussion is made on the heat capacity of the outdoor heat exchanger 3 while the thickness of the heat transfer pipe 25B is treated as a parameter however, the present invention is not limited to this configuration. For example, as the thickness of the heat transfer pipe 25B increases, the weight of the heat transfer pipe 25B increases accordingly. As the weight of the heat transfer pipe 25B increases, the total heat capacity of the outdoor heat exchanger 3 increases accordingly. Thus, when the number of the heat transfer pipes 25B is fixed, the total weight of the heat transfer pipe 25B is set so that the ratio of the heat capacity of the plurality of fins 25A to the total of heat capacities of the heat transfer pipe 25B and the plurality of fins 25A is not more than 50%.

Figure 5:
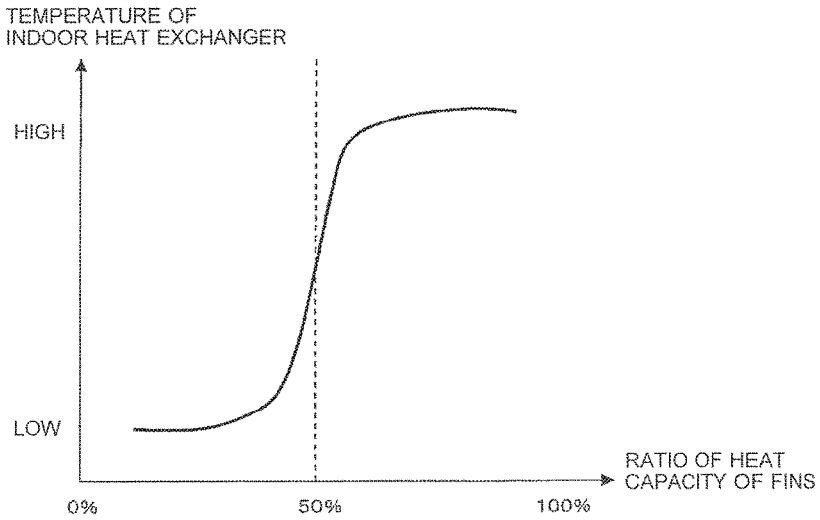
FIG. 5 is a graph indicating a relation between a ratio of a heat capacity of the fin 25A to a total of heat capacities of the fin 25A and the heat transfer pipe 25B, and an indoor temperature during a reverse-defrosting operation.

FIG. 5 is a graph indicating a relation between the ratio of the heat capacity of the fins 25A to the total of the heat capacities of the fins 25A and the heat transfer pipe 25B, and an indoor temperature during a reverse-defrosting operation. In FIG. 5, the horizontal axis represents the ratio of the plurality of fins 25A of the outdoor heat exchanger 3, and the vertical axis represents the indoor temperature. The following describes, with reference to FIG. 5, an effect of the reverse-defrosting operation performed on the outdoor heat exchanger 3 when the ratio of the heat capacity of the fins 25A is small.

When the ratio of the heat capacity of the plurality of fins 25A to the total of heat capacities of the heat transfer pipe 25B and the plurality of fins 25A is more than 50%, the thickness of the heat transfer pipe 25B is not much increased, and the total heat capacity of the outdoor heat exchanger 3 is small. Thus, when the reverse-defrosting operation is performed by using the indoor unit 101 as a heat radiating source, the amount of heat supplied to the outdoor heat exchanger 3 from the indoor heat exchanger 5 of the indoor unit 101 is reduced. Consequently, the temperature of the indoor heat exchanger 5 of the indoor unit 101 is high.

When the heat capacity of the plurality of fins 25A is not more than 50%, the temperature of the indoor heat exchanger 5 of the indoor unit 101 abruptly decreases. In other words, an inflection point exists at 50% or a value around 50%.

When the ratio of the heat capacity of the plurality of fins 25A to the total of heat capacities of the heat transfer pipe 25B and the plurality of fins 25A is not more than 50%, the thickness of the heat transfer pipe 25B is increased for a fixed number of the heat transfer pipes 25B, for example. In this case, the total heat capacity of the outdoor heat exchanger 3 increases by an amount corresponding to the increase of the thickness. Thus, when the reverse-defrosting operation is performed by using the indoor unit 101 as a heat radiating source, an amount of heat at the indoor unit 101 supplied to the outdoor heat exchanger 3 is increased. As a result, the temperature at the indoor unit 101 decreases. Thus, when a heating operation is started after the reverse-defrosting operation is completed, extra time is required for a rise of the heating operation.

As described with reference to FIGS. 4A, 4B, and 5, as the heat transfer pipe 25B is made of aluminum, the outdoor heat exchanger 3 has an increased total heat capacity. However, when only the reverse-defrosting operation is performed to finish earlier a defrosting operation on the outdoor heat exchanger 3 having an increased total heat capacity, the rise of the heating operation is slowed. When only a hot gas defrosting operation is performed, too much time is required for defrosting in some cases. For these reasons, the refrigeration cycle apparatus 200 performs a mixed defrosting operation described next for the defrosting operation.

[Defrosting Operation Mode]

Figures 6, 7:
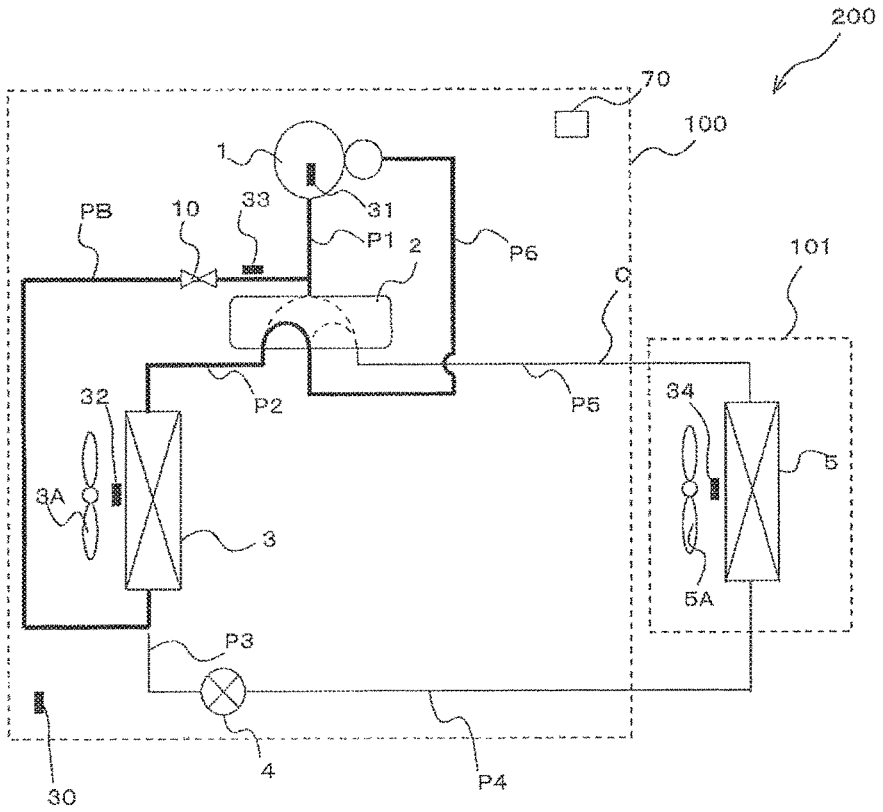
FIG. 6 is an explanatory diagram of an outside air temperature condition indicating which of a hot gas defrosting operation, the reverse-defrosting operation, and a mixed defrosting operation in which the hot gas defrosting operation and the reverse-defrosting operation are performed in sequence is performed.
FIG. 7 is a diagram illustrating a flow of refrigerant during the hot gas defrosting operation.
Figure 8:
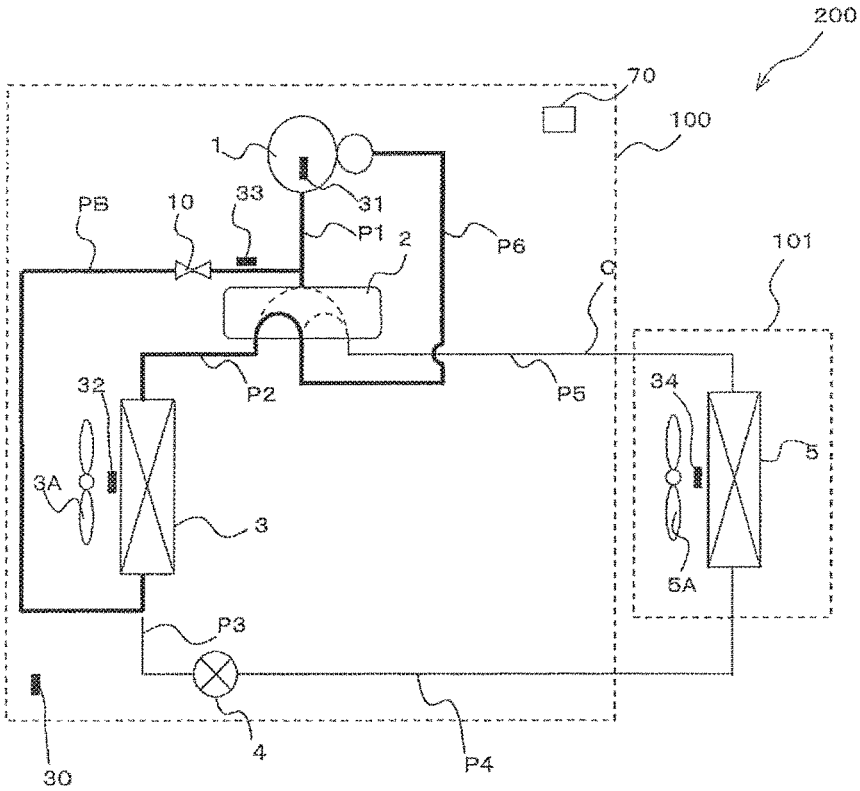
FIG. 8 is a diagram illustrating a flow of refrigerant during the reverse-defrosting operation.

FIG. 6 is an explanatory diagram of an outside air temperature condition indicating which of the hot gas defrosting operation mode, the reverse-defrosting operation mode, and the mixed defrosting operation mode in which the hot gas defrosting operation mode and the reverse-defrosting operation mode are performed in sequence is executed. FIG. 7 is a diagram illustrating a flow of the refrigerant in the hot gas defrosting operation mode. FIG. 8 is a diagram illustrating a flow of the refrigerant in the reverse-defrosting operation mode. The hot gas defrosting operation mode, the reverse-defrosting operation mode, and the mixed defrosting operation mode will be described with reference to FIGS. 6 to 8.

(Hot Gas Defrosting Operation Mode)

In the hot gas defrosting operation mode, the indoor unit 101 is not used as a heat radiating source. In other words, the hot gas defrosting operation mode is an operation mode in which the hot gas defrosting operation in which hot gas refrigerant discharged from the compressor 1 is supplied to the outdoor heat exchanger 3 by bypassing the indoor heat exchanger 5 is performed. Specifically, the controller 70 closes the expansion device 4 and opens the opening-closing device 10. The controller 70 also switches passages so that the flow switching device 2 is switched to cooling. With this configuration, the refrigerant discharged from the compressor 1 flows through the refrigerant pipe P1, the bypass pipe PB, the refrigerant pipe P3, the outdoor heat exchanger 3, the refrigerant pipe P2, the flow switching device 2, and the refrigerant pipe P6, and then returns to the suction side of the compressor 1 (refer to FIG. 7).

In the hot gas defrosting operation mode, the controller 70 may operate or stop the outdoor fan 3A and the indoor fan 5A. When the indoor fan 5A is operated in the hot gas defrosting operation mode, indoor heating can be achieved by heat remaining in the indoor heat exchanger 5. In other words, this configuration achieves an effect of heating even during the defrosting operation. When the outdoor fan 3A is operated in the hot gas defrosting operation mode, air is supplied to the outdoor heat exchanger 3, thereby facilitating defrosting in some cases.

When the hot gas defrosting operation mode is executed, the controller 70 preferably controls so that the compressor 1 has, for example, a maximum rotation frequency. This configuration allows supply of gas refrigerant at a higher temperature to the outdoor heat exchanger 3, thereby highly efficiently defrosting the outdoor heat exchanger 3.

During the hot gas defrosting operation, high pressure depends on the outside air temperature. In other words, during the hot gas defrosting operation, the indoor unit 101 is not used as a heat radiating source, and higher defrosting performance is achieved at a higher outside air temperature. Thus, as illustrated in FIG. 6, the hot gas defrosting operation is independently performed at a temperature higher than a second temperature. At a temperature higher than a first temperature and equal to or lower than the second temperature, the hot gas defrosting operation is performed together with the reverse-defrosting operation. When the Cv value of a valve of the opening-closing device 10 is fixed (an opening degree of the opening-closing device 10 is fixed) during the hot gas defrosting operation, low pressure during defrosting depends on high pressure. The first temperature is, for example, 0 degrees C., and the second temperature is, for example, 2 degrees C.

(Reverse-Defrosting Operation Mode)

In the reverse-defrosting operation mode, the indoor unit 101 is used as a heat radiating source, and higher defrosting performance is achieved by using latent heat of the refrigerant than that during the hot gas defrosting operation. Thus, defrosting of the outdoor heat exchanger 3 can be completed in a short time. The reverse-defrosting operation mode is an operation mode in which the reverse-defrosting operation in which the flow of the refrigerant is reversed to the flow during the heating operation is performed. Specifically, the controller 70 opens the expansion device 4 and closes the opening-closing device 10. The controller 70 also switches passages so that the flow switching device 2 is switched to cooling. Thus, the refrigerant discharged from the compressor 1 flows through the refrigerant pipe P1, the flow switching device 2, the refrigerant pipe P2, the outdoor heat exchanger 3, the refrigerant pipe P3, the expansion device 4, the refrigerant pipe P4, the indoor heat exchanger 5, the refrigerant pipe P5, the flow switching device 2, and the refrigerant pipe P6, and returns to the suction side of the compressor 1 (refer to FIG. 8).

In the reverse-defrosting operation mode, the controller 70 stops the outdoor fan 3A and the indoor fan 5A. This is because when the indoor fan 5A is operated in the reverse-defrosting operation mode, the indoor heat exchanger 5 serves as an evaporator, and thus indoor supply of cool air potentially degrades comfort for a user.

In the reverse-defrosting operation mode, when the outdoor fan 3A is operated, imbalance of the refrigerant (refrigerant distribution) is caused in the refrigerant circuit C, and thus the outdoor fan 3A is stopped to avoid this imbalance. In other words, the outdoor fan 3A is stopped because refrigerant is too much on a side of the outdoor unit 100 to degrade the efficiency of the reverse-defrosting operation mode. The reverse-defrosting operation mode is on an assumption of an operation under a condition with a low outside air temperature, because application of low temperature air cannot effectively remove frost but leads to increased electric power consumption.

When the reverse-defrosting operation mode is executed, the controller 70 preferably controls so that the compressor 1 has, for example, a maximum rotation frequency. This configuration allows supply of gas refrigerant at a higher temperature to the outdoor heat exchanger 3, thereby highly efficiently defrosting the outdoor heat exchanger 3.

During the reverse-defrosting operation, the indoor fan 5A of the indoor unit 101 is stopped, and thus natural convection of air reduces low pressure. At an end of the defrosting operation, the temperature of the indoor heat exchanger 5 of the indoor unit 101 is about −30 degrees C. in some cases. This configuration achieves high frost removing performance, but slows the rise of the heating operation. During the reverse-defrosting operation, as defrosting proceeds, a refrigerant flow in the refrigerant circuit C decreases to degrade defrosting performance.

As illustrated in FIG. 6, the reverse-defrosting operation is independently performed at a temperature equal to or lower than the first temperature. At a temperature higher than the first temperature and equal to or lower than the second temperature, the reverse-defrosting operation is performed in sequence after the hot gas defrosting operation is performed.

(Mixed Defrosting Operation Mode)

In the refrigeration cycle apparatus 200, the heat transfer pipe 25B is made of aluminum, and the mixed defrosting operation mode is prepared to reduce too much time required for the rise of the heating operation and defrosting even for an increased total heat capacity of the outdoor heat exchanger 3. The controller 70 starts the mixed defrosting operation mode when the outside air temperature is higher than the first temperature and equal to or lower than the second temperature higher than the first temperature.

When the mixed defrosting operation mode is executed, the controller 70 first performs the hot gas defrosting operation. After the hot gas defrosting operation is performed, the controller 70 performs the reverse-defrosting operation in sequence. Thus, increase in time required for the rise of the heating operation and too much time required for defrosting can be both reduced by achieving a certain amount of defrosting during the hot gas defrosting operation, and then removing remaining frost through reverse defrosting.

The hot gas defrosting operation transitions to the reverse-defrosting operation under various conditions. In the present embodiment, the controller 70 starts the reverse-defrosting operation of the mixed defrosting operation when a measured temperature obtained by the outdoor heat exchanger temperature sensor 32 is equal to or lower than a third temperature after a preset time has elapsed since a start of the hot gas defrosting operation of the mixed defrosting operation. The third temperature is preferably set to be, for example, lower than the second temperature, and is preferably set to be, for example, 0 degrees C. same as the first temperature.

[Control Process]

Figure 9:
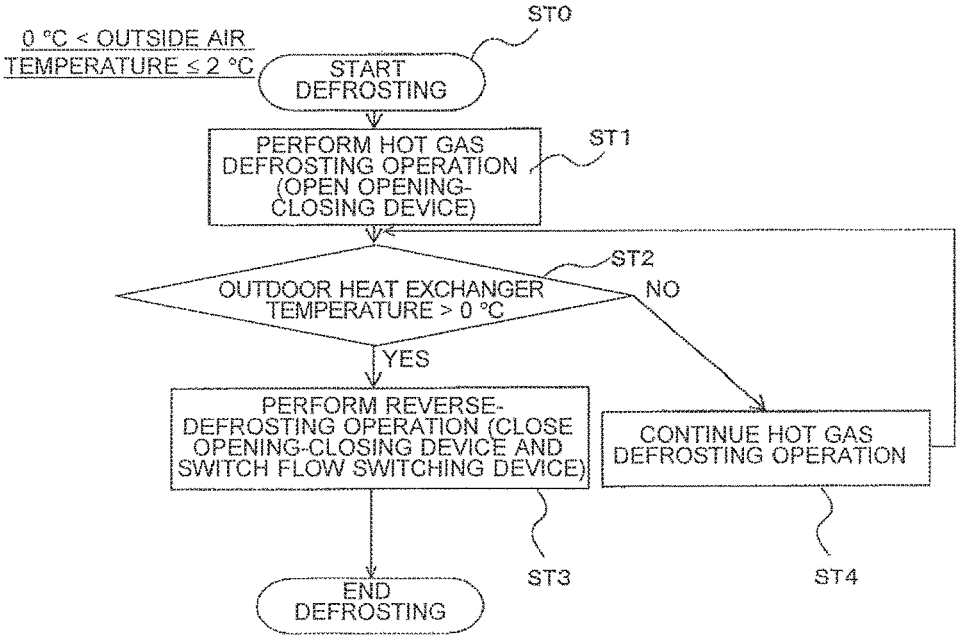
FIG. 9 illustrates an exemplary control process of the refrigeration cycle apparatus 200 according to the embodiment of the present invention.

FIG. 9 illustrates an exemplary control process of the refrigeration cycle apparatus 200 according to the present embodiment. The following describes an exemplary control process of the mixed defrosting operation mode executed by the controller 70 with reference to FIG. 9.

(Step ST0)

The controller 70 determines which of the defrosting operation modes is to be executed. The determination on the defrosting operation modes may be made on the basis of, for example, a condition indicating whether a preset time has elapsed since a start of an operation of the refrigeration cycle apparatus 200. Alternatively, the refrigeration cycle apparatus 200 may be configured to allow the user to manually start a defrosting operation mode.

At the present step ST0, the controller 70 receives data that a measured temperature obtained by the outside air temperature sensor 30 is higher than the first temperature and equal to or lower than the second temperature. Then, the controller 70 starts the mixed defrosting operation mode.

(Step ST1)

The controller 70 starts the hot gas defrosting operation of the mixed defrosting operation mode. The controller 70 closes the expansion device 4 and opens the opening-closing device 10 without switching the flow switching device 2. The controller 70 also sets the rotation frequency of the compressor 1 to be at the maximum. The controller 70 operates the outdoor fan 3A and the indoor fan 5A. The present example describes a case in which the controller 70 sets the rotation frequency of the compressor 1 to be at the maximum and operates the outdoor fan 3A and the indoor fan 5A.

(Step ST2)

The controller 70 determines whether (1) the preset time has elapsed and (2) the measured temperature obtained by the outdoor heat exchanger temperature sensor 32 is higher than 0 degrees C. When the preset time is determined to have elapsed and the measured temperature obtained by the outdoor heat exchanger temperature sensor 32 is determined to be higher than 0 degrees C., the controller 70 ends the hot gas defrosting operation and proceeds to step ST3.

(Step ST3)

The controller 70 starts the reverse-defrosting operation of the mixed defrosting operation mode. The controller 70 switches the flow switching device 2 to cooling, opens the expansion device 4, and closes the opening-closing device 10. The controller 70 also sets the rotation frequency of the compressor 1 to be at the maximum. The controller 70 stops the outdoor fan 3A and the indoor fan 5A. The present example describes a case in which the controller 70 sets the rotation frequency of the compressor 1 to be at the maximum.

(Step ST4)

When the condition at step ST2 is not satisfied, the controller 70 continues the hot gas defrosting operation. After step ST4, the controller 70 returns to step ST2. As described above, (1) the preset time has already elapsed when the controller 70 returns to step ST2 after step ST4, the controller 70 may determine only (2) whether the measured temperature obtained by the outdoor heat exchanger temperature sensor 32 is higher than 0 degrees C. Alternatively, the controller 70 may reset time measuring and determine again whether (1) the preset time has elapsed and (2) the measured temperature obtained by the outdoor heat exchanger temperature sensor 32 is higher than 0 degrees C.

[Configuration of the Controller 70]

Figure 10:
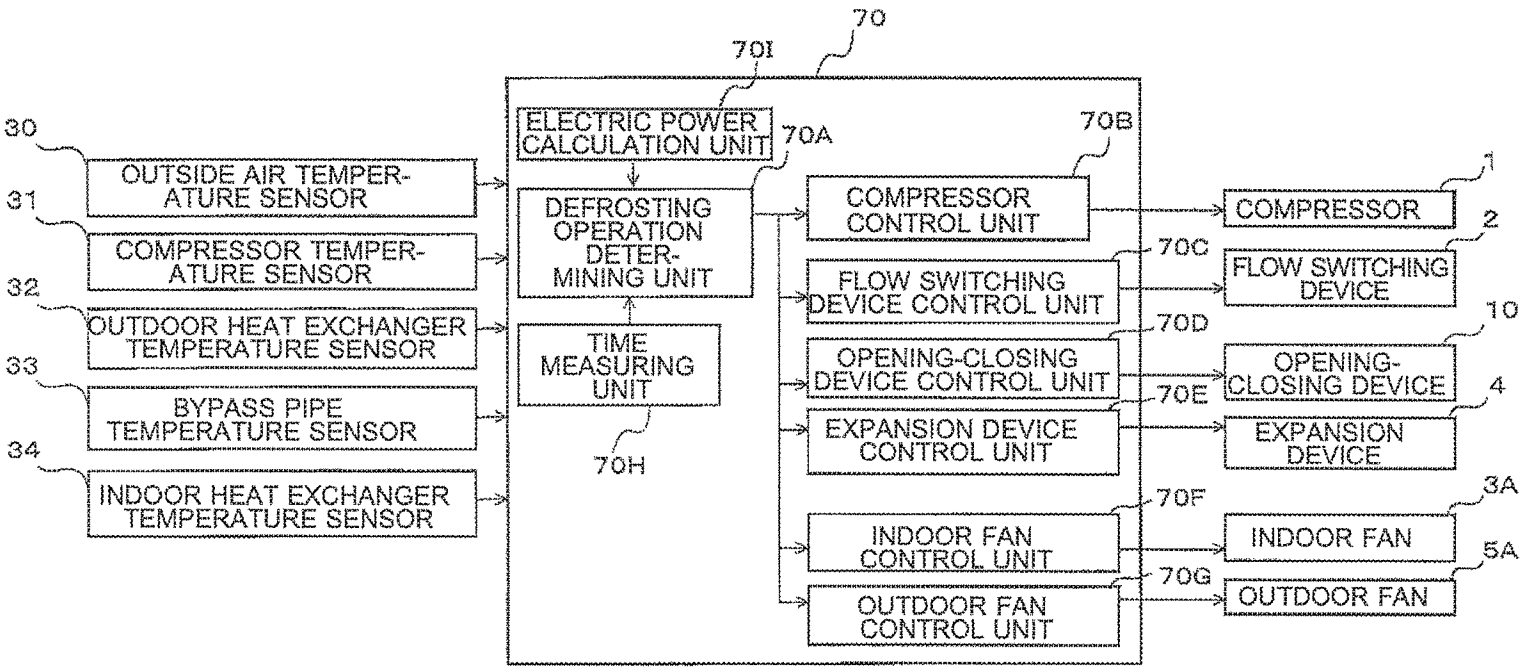
FIG. 10 is a block diagram for description of configurations of a controller 70 and other components.

FIG. 10 is a block diagram for description of configurations of the controller 70 and other components. The following describes exemplary configurations of the controller 70 and other components with reference to FIG. 10.

The controller 70 includes a defrosting operation determining unit 70A that determines which of the defrosting operation modes is to be executed, a compressor control unit 70B that controls the compressor 1, a flow switching device control unit 70C that controls the flow switching device 2, an opening-closing device control unit 70D that controls the opening-closing device 10, an expansion device control unit 70E that controls the expansion device 4, an indoor fan control unit 70F that controls the indoor fan 5A, an outdoor fan control unit 70G that controls the outdoor fan 3A, a time measuring unit 70H that has a function of calculating a time elapse, and an electric power calculation unit 70I that calculates electric power supplied to the compressor 1.

The defrosting operation determining unit 70A may be formed of, for example, various calculation circuits. The compressor control unit 70B, the indoor fan control unit 70F, and the outdoor fan control unit 70G may be each formed of, for example, an inverter circuit.

The expansion device 4 is, for example, a magnetic-induction electronic control valve that includes a magnet provided to a shaft of a valve body, a Hall element configured to detect a rotational displacement of the magnet, and a motor that rotates the valve body. In this case, the flow switching device control unit 70C, the opening-closing device control unit 70D, and the expansion device control unit 70E may be each formed of, for example, a circuit that rotates the motor on the basis of a signal from the Hall element.

The flow switching device 2 and the opening-closing device 10 are each formed of, for example, a solenoid valve that operates a plunger through energization to a solenoid (coil). In this case, the flow switching device control unit 70C and the opening-closing device control unit 70D may be each formed of, for example, a circuit capable of switching energization to the solenoid.

The time measuring unit 70H may be formed of, for example, a predetermined time measuring circuit.

In the compressor 1, for example, a motor current detection unit is provided on wiring connecting an inverter circuit and a motor of the compressor 1. In this case, the electric power calculation unit 70I may be formed of, for example, a circuit that calculates an input electric power from an output voltage command value of the inverter circuit, and an output current of the inverter circuit detected by the motor current detection unit.

The defrosting operation determining unit 70A determines to execute one of the defrosting operation modes, for example, when the time measuring unit 70H determines that the preset time has elapsed since the start of the heating operation. Then, the defrosting operation determining unit 70A determines to start the mixed defrosting operation mode when the measured temperature obtained by the outside air temperature sensor 30 is higher than the first temperature and equal to or lower than the second temperature. The defrosting operation determining unit 70A determines to start the reverse-defrosting operation mode when the measured temperature obtained by the outside air temperature sensor 30 is equal to or lower than the first temperature, and to start the hot gas defrosting operation mode when the measured temperature is higher than the second temperature.

The following describes an example in which the mixed defrosting operation mode is executed as a defrosting operation mode. When the defrosting operation determining unit 70A determines to perform the mixed defrosting operation, the compressor control unit 70B sets the rotation frequency of the compressor 1 to be, for example, at the maximum, the flow switching device control unit 70C does not switch the flow switching device 2, the opening-closing device control unit 70D opens the opening-closing device 10, and the expansion device control unit 70E closes the expansion device 4. When the defrosting operation determining unit 70A determines to perform the mixed defrosting operation, the indoor fan control unit 70F may operate the indoor fan 5A, and the outdoor fan control unit 70G may operate the outdoor fan 3A.

When the time measuring unit 70H determines that the preset time has elapsed since the start of the mixed defrosting operation (hot gas defrosting operation of the mixed defrosting operation), the defrosting operation determining unit 70A determines whether the measured temperature obtained by the outdoor heat exchanger temperature sensor 32 is the third temperature (for example, 0 degrees C.) lower than the second temperature. When the measured temperature is decided to be equal to or lower than the third temperature, the defrosting operation determining unit 70A transitions to the reverse-defrosting operation.

When the defrosting operation determining unit 70A determines to transition to the reverse-defrosting operation, the compressor control unit 70B sets the rotation frequency of the compressor 1 to be, for example, at the maximum, the flow switching device control unit 70C switches the flow switching device 2 to cooling, the opening-closing device control unit 70D closes the opening-closing device 10, and the expansion device control unit 70E opens the expansion device 4. The indoor fan control unit 70F stops the indoor fan 5A, and the outdoor fan control unit 70G stops the outdoor fan 3A.

When the time measuring unit 70H determines that the preset time has elapsed since the start of the mixed defrosting operation (reverse-defrosting operation of the mixed defrosting operation), the defrosting operation determining unit 70A ends the mixed defrosting operation. In other words, the compressor control unit 70B stops the compressor 1.

[Effect Achieved by the Refrigeration Cycle Apparatus 200 According to the Present Embodiment]

The refrigeration cycle apparatus 200 according to the present embodiment can select the mode of the defrosting operation in response to a load of the defrosting operation corresponding to the outside air temperature. Specifically, the refrigeration cycle apparatus 200 according to the present embodiment includes three modes described next to allow the selection in response to the load of the defrosting operation corresponding to the outside air temperature.

The refrigeration cycle apparatus 200 according to the present embodiment includes the hot gas defrosting operation mode in which the hot gas defrosting operation is performed when the outside air temperature is higher than the second temperature. The hot gas defrosting operation has its performance depending on the outside air temperature, and has an advantage when the outside air temperature is higher than the second temperature.

The refrigeration cycle apparatus 200 according to the present embodiment includes the reverse-defrosting operation mode in which the reverse-defrosting operation is performed when the outside air temperature is equal to or lower than the first temperature. Under an environment in which the outside air temperature is at a low temperature equal to or lower than the first temperature, the hot gas defrosting operation potentially cannot achieve sufficient performance. Thus, under such an environment, the refrigeration cycle apparatus 200 performs the reverse-defrosting operation to more reliably achieve defrosting of the outdoor heat exchanger 3.

The refrigeration cycle apparatus 200 according to the present embodiment includes the mixed defrosting operation mode in which the mixed defrosting operation is performed when the outside air temperature is higher than the first temperature and equal to or lower than the second temperature. Under the condition that the outside air temperature is higher than the first temperature and equal to or lower than the second temperature, sufficient defrosting performance potentially cannot be achieved only by the hot gas defrosting, and alternatively, the rise of heating is potentially slowed by a significant degree only by the reverse defrosting. Thus, under such a condition, the refrigeration cycle apparatus 200 according to the present embodiment performs the mixed defrosting operation. This configuration can reduce both an increase in a defrosting time and an increase in the time required for the rise of the heating operation.

The refrigeration cycle apparatus 200 according to the present embodiment includes the heat transfer pipe 25B made of aluminum and is configured so that the ratio of the heat capacity of the fins 25A to the total of the heat capacities of the heat transfer pipe 25B and the fins 25A is not more than 50%. As the heat transfer pipe 25B is made of aluminum, a manufacturing cost of the outdoor heat exchanger 3 can be reduced, but an increase in the total heat capacity of the outdoor heat exchanger 3 is caused by an increase in the thickness of the heat transfer pipe 25B. However, as the refrigeration cycle apparatus 200 according to the present embodiment includes the mixed defrosting operation mode, the outdoor heat exchanger 3 having the above-described configuration can achieve both reduction of an increased defrosting time and reduction of an increased time required for the rise of the heating operation.

In the refrigeration cycle apparatus 200 according to the present embodiment, the refrigerant sealed in the refrigerant circuit C may be, for example, R1123 refrigerant or a mixed refrigerant of R1123 refrigerant and R32 refrigerant. During the hot gas defrosting operation, the refrigerant flow increases. Thus, the use of R1123 refrigerant having a density higher than that of R32 refrigerant enables more efficient defrosting of the outdoor heat exchanger 3 through the hot gas defrosting operation.

The refrigeration cycle apparatus 200 according to the present embodiment is applicable to, for example, an air-conditioning apparatus.

The above description is made on the embodiment in which, in the refrigeration cycle apparatus 200 according to the present embodiment, the outdoor heat exchanger 3 includes the heat transfer pipe 25B that is a circular pipe;

however, the present invention is not limited to this configuration. For example, the heat transfer pipe 25B may be a flat pipe. The flat pipe can be reduced in size but is likely to have an increased thickness as compared to the circular pipe. For example, for a heat exchanger with a similar dimension, the flat pipe has a heat capacity 1.7 times (approximately twice, when a header or other components are included) larger than that of the circular pipe.

Thus, when the heat transfer pipe 25B of the outdoor heat exchanger 3 is not only made of aluminum but also a flat pipe, an increase in the thickness is more significant, and the total heat capacity of the outdoor heat exchanger 3 is further increased. However, the refrigeration cycle apparatus 200 according to the present embodiment can perform the mixed defrosting operation, and thus can achieve both reduction of an increased defrosting time and reduction of an increased time required for the rise of the heating operation even when an increase in the thickness is more significant, and the total heat capacity of the outdoor heat exchanger 3 is increased.

[Modification]

In the present embodiment, the temperature of the outdoor heat exchanger 3 is used as a condition on a transition from the hot gas defrosting operation to the reverse-defrosting operation in the mixed defrosting operation mode; however, the present invention is not limited to this configuration, and the temperature of the refrigerant discharged from the compressor 1 may be used instead.

Specifically, the controller 70 may be configured to start the reverse-defrosting operation of the mixed defrosting operation mode when a measured temperature obtained by the compressor temperature sensor 31 is lower than a fourth temperature after the preset time has elapsed since the start of the hot gas defrosting operation of the mixed defrosting operation mode. The fourth temperature is preferably set to be higher than the second temperature, and may be, for example, 20 degrees C.

The temperature of the refrigerant flowing through the bypass pipe PB may be used as a condition on a transition from the hot gas defrosting operation to the reverse-defrosting operation in the mixed defrosting operation mode.

Specifically, the controller 70 may be configured to start the reverse-defrosting operation of the mixed defrosting operation mode when a measured temperature obtained by the bypass pipe temperature sensor 33 is lower than a fifth temperature after the preset time has elapsed since the start of the hot gas defrosting operation of the mixed defrosting operation mode. The fifth temperature is preferably set to be higher than the second temperature, and may be, for example, 20 degrees C.

The temperature of the indoor heat exchanger 5 may be used as a condition on a transition from the hot gas defrosting operation to the reverse-defrosting operation in the mixed defrosting operation mode.

Specifically, the controller 70 may be configured to start the reverse-defrosting operation of the mixed defrosting operation mode when a measured temperature obtained by the indoor heat exchanger temperature sensor 34 is equal to or higher than a sixth temperature after the preset time has elapsed since the start of the hot gas defrosting operation of the mixed defrosting operation mode. The sixth temperature is preferably set to be higher than the second temperature, and may be, for example, 30 degrees C. When the indoor heat exchanger 5 has a temperature equal to or higher than 30 degrees C., the indoor heat exchanger 5 effectively serves as a heat radiating source, and the use as a heat radiating source does not proceed cooling too much but can suppress slow rise of heating.

The electric power or rotation frequency of the outdoor fan 3A may be used as a condition on a transition from the hot gas defrosting operation to the reverse-defrosting operation in the mixed defrosting operation mode.

Specifically, the controller 70 includes the electric power calculation unit 70I that calculates an electric power supplied to the outdoor fan 3A, and may be configured to start the reverse-defrosting operation of the mixed defrosting operation mode when the electric power is lower than a preset value after the preset time has elapsed since the start of the hot gas defrosting operation of the mixed defrosting operation mode.

Alternatively, the refrigeration cycle apparatus 200 may include a rotation frequency measurement sensor (not illustrated) that measures the rotation frequency of the compressor 1, and the controller 70 may be configured to start the reverse-defrosting operation of the mixed defrosting operation mode when the rotation frequency is lower than a preset value after the preset time has elapsed since the start of the hot gas defrosting operation of the mixed defrosting operation mode.

REFERENCE SIGNS LIST

1 compressor, 2 flow switching device, 3 outdoor heat exchanger, 3A outdoor fan, 4 expansion device, 5 indoor heat exchanger, 5A indoor fan, 10 opening-closing device, 11 base plate, 25A fin, 25B heat transfer pipe, 30 outside air temperature sensor, 31 compressor temperature sensor, 32 outdoor heat exchanger temperature sensor, 33 bypass pipe temperature sensor, 34 indoor heat exchanger temperature sensor, 70 controller, 70A defrosting operation determining unit, 70B compressor control unit, 70C flow switching device control unit, 70D opening-closing device control unit, 70E expansion device control unit, 70F indoor fan control unit, 70G outdoor fan control unit, 70H time measuring unit, 70I electric power calculation unit, 100 outdoor unit, 101 indoor unit, 110 housing, 110A front panel, 110B side panel, 110C back panel, 110D top panel, 111 base plate, 111A drain hole, 112 motor support, 114 dividing plate, 200 refrigeration cycle apparatus, C refrigerant circuit, P1 refrigerant pipe, P2 refrigerant pipe, P3 refrigerant pipe, P4 refrigerant pipe, P5 refrigerant pipe, P6 refrigerant pipe, PB bypass pipe

The invention claimed is:

1. A refrigeration cycle apparatus comprising:

a refrigerant circuit including a compressor, an indoor heat exchanger, an expansion device, and an outdoor heat exchanger connected to each other via refrigerant pipes;

an outside air temperature sensor configured to measure an outside air temperature;

an outdoor heat exchanger temperature sensor configured to measure a temperature of the outdoor heat exchanger; and a controller configured to perform a hot gas defrosting operation and a reverse-defrosting operation on a basis of a measured temperature obtained by the outside air temperature sensor and a measured temperature obtained by the outdoor heat exchanger temperature sensor, in the hot gas defrosting operation, hot gas discharged from the compressor without passing through the indoor heat exchanger being supplied to the outdoor heat exchanger, in the reverse-defrosting operation, refrigerant passing through the indoor heat exchanger being supplied from the compressor to the outdoor heat exchanger, the controller having a mixed defrosting operation mode in which the hot gas defrosting operation and the reverse-defrosting operation are performed in sequence when the measured temperature obtained by the outside air temperature sensor is higher than a first temperature and equal to or lower than a second temperature higher than the first temperature, and a reverse-defrosting operation mode in which the reverse-defrosting operation is performed when the measured temperature obtained by the outside air temperature sensor is equal to or lower than the first temperature, the controller being configured to start the reverse-defrosting operation of the mixed defrosting operation mode when the measured temperature obtained by the outdoor heat exchanger temperature sensor is equal to or lower than a third temperature lower than the second temperature during a performance of the hot gas defrosting operation of the mixed defrosting operation mode.

2. The refrigeration cycle apparatus of claim 1, wherein the controller further has a hot gas defrosting operation mode in which the hot gas defrosting operation is started when the measured temperature obtained by the outside air temperature sensor is higher than the second temperature.

3. The refrigeration cycle apparatus of claim 2, wherein the controller is configured to start the reverse-defrosting operation of the mixed defrosting operation mode when the measured temperature obtained by the outdoor heat exchanger temperature sensor is equal to or lower than the third temperature lower than the second temperature after a preset time has elapsed since the start of the hot gas defrosting operation of the mixed defrosting operation mode.

4. The refrigeration cycle apparatus of claim 2, further comprising a compressor temperature sensor configured to measure a temperature of the refrigerant discharged from the compressor, wherein the controller is configured to start the reverse-defrosting operation of the mixed defrosting operation mode when a measured temperature obtained by the compressor temperature sensor is lower than a fourth temperature higher than the second temperature after a preset time has elapsed since the start of the hot gas defrosting operation of the mixed defrosting operation mode.

5. The refrigeration cycle apparatus of claim 1, further comprising:

an outdoor fan provided to the outdoor heat exchanger and configured to supply air to the outdoor heat exchanger; and an indoor fan provided to the indoor heat exchanger and configured to supply air to the indoor heat exchanger, wherein the controller is configured to stop the outdoor fan and the indoor fan during the reverse-defrosting operation.

6. The refrigeration cycle apparatus of claim 1, wherein R1123 refrigerant or a mixed refrigerant of R1123 refrigerant and R32 refrigerant is sealed in the refrigerant circuit.

7. An air-conditioning apparatus comprising the refrigeration cycle apparatus of claim 1 including an outdoor unit on which at least the compressor and the outdoor heat exchanger are mounted, and an indoor unit on which at least the indoor heat exchanger is mounted.

* * * * *